United States Patent [19]

Hodges et al.

[11] Patent Number: 4,903,621

[45] Date of Patent: Feb. 27, 1990

[54] HOSIERY TOE CLOSING METHOD AND APPARATUS

[75] Inventors: Michael J. Hodges; Sydney Beal, both of High Wycombe, England

[73] Assignee: Detexomat Machinery Limited, Buckinghamshire, England

[21] Appl. No.: 283,966

[22] Filed: Dec. 13, 1988

[30] Foreign Application Priority Data

Dec. 24, 1987 [GB] United Kingdom ..... 8730199

[51] Int. Cl.[4] ..... D05B 21/00

[52] U.S. Cl. ..... 112/121.15; 112/262.2; 223/112

[58] Field of Search ..... 112/121.15, 121.11, 112/121.12; 223/112, 43, 75

[56] References Cited

U.S. PATENT DOCUMENTS

| | | | |
|---|---|---|---|
| 3,450,075 | 6/1969 | Bridgeman . | |
| 3,457,885 | 7/1969 | Sattiel . | |
| 4,364,320 | 12/1982 | Nakhle et al. | 112/121.15 X |
| 4,602,710 | 7/1986 | Bell, Jr. et al. | 112/121.15 X |
| 4,609,419 | 9/1986 | Hodges | 112/121.15 X |
| 4,649,838 | 3/1987 | Gazzarrini | 223/43 X |

FOREIGN PATENT DOCUMENTS

| | | |
|---|---|---|
| 0075477 | 3/1983 | European Pat. Off. . |
| 0121956 | 10/1984 | European Pat. Off. . |
| 0126800 | 12/1987 | European Pat. Off. . |
| 2328831 | 12/1972 | Fed. Rep. of Germany . |
| 1039605 | 8/1966 | United Kingdom . |
| 1408912 | 10/1975 | United Kingdom . |
| 2074203 | 10/1981 | United Kingdom . |

*Primary Examiner*—H. Hampton Hunter

*Attorney, Agent, or Firm*—Dority & Manning

[57] ABSTRACT

The toe end of a hose blank has a looper line bead and is toe closed by movement past a seamer along a seam line located by reference to the bead, the blank being mounted on a toe closer carrier of conventional form. Opposed blades of the carrier execute a forward movement to pass the beaded end of the blank through a space between two open jaws of a positioning device; the jaws thereafter close and by drawing the blank backwards the bead is brought against the jaws, which are at a pre-set location relative to the seamer and the toe end is thereby positioned ready for seaming. The toe end is then conveyed to and past the seamer by a transport belt, the positioning established by the jaws being maintained during conveyance of the blank to seamer.

13 Claims, 5 Drawing Sheets

HOSIERY TOE CLOSING METHOD AND APPARATUS

The present invention relates to a hosiery toe closing method and apparatus.

More particularly, the invention is concerned with toe seaming hosiery blanks in the form of knitted tubes which terminate in a thickened "barrier" or bead. It is commonplace to incorporate such a barrier or bead in hose blanks, especially in such blanks as are used in the production of half hose and socks. The barrier or bead is often called a looper line or a linking line.

In the production of a looper line blank, the bead or barrier is at a predetermined location. For example, its position is at a predetermined location relative to a heel or toe reinforcement, or to a toe formation or pocket, of the foot portion of the blank.

The looper line is effectively used as a reference in a looper line closing machine, whereby toe closed hose can be repetitively produced with a minimum of variation in the positioning of the toe seams and hence with a minimum of variation in the length of the feet portions of the hose.

Looper line closers currently available to the hosiery industry are specialized machines and relatively expensive. Moreover, their outputs are felt to be unsatisfactory.

Over the years, machines for toe closing ladies stockings have been developed to a high state of sophistication, reliability and productivity. They are not confined to the closing of ladies stockings, however. Versions have been produced for successfully toe closing heavier hose including toe blanks.

An object of this invention has been to devise a method of closing looper line hose blanks which can be performed on a specially-adapted toe closer, and another object has been to develop a toe closer which can successfully close such blanks. In developing this invention, we have sought to incorporate in a toe closer a device especially designed to coact with the looper line for accurately controlling positioning of the blank. For a variety of reasons, we have aimed to produce a device which is simple in operation and which neither interferes to any significant extent with the normal sequence of operations of a toe closer, nor appreciably reduces the toe closing operation.

According to the present invention, there is provided a method of closing the toe end of a hose blank which terminates in a bead or barrier, which comprises the use of a toe closer which transports the toe end in a flattened state along a path past a seamer while the latter generates a closing seam thereacross wherein, to predetermine the location of the seam, the toe end is advanced through an arrangement comprising two open positioning jaws located in a pre-set relation to the path of transport and the seamer, the jaws are brought toward a closing setting, the blank is retracted to abut its bead or barrier against the jaws thereby positioning the bead or barrier, and the positioning established by the jaws is preserved while the toe end is being transported along the said path.

Also according to the present invention, there is provided a toe closer for closing the toe end of a hosiery blank which terminates in a bead or barrier, comprising a seamer and means to transport the toe end of a blank in a flattened state along a path past the seamer for the latter to generate a toe closing seam across the blank, the closer further including means to position a blank before transport to the seamer, the positioning means comprising an initially open pair of jaws located in a pre-set relation to the path of transport and the seamer, means for presenting the end of a blank through the open jaws and means for closing the jaws about the end of a blank presented therebetween, whereby in use a blank is positioned by retraction of the blank until the terminal bead or barrier thereof abuts the closed jaws.

Toe closers can be built from the outset so as to embody the invention, or existing toe closers can be modified by the addition of extra components to embody the invention.

The present invention will now be described in more detail by way of example only with reference to the accompanying drawings, in which.

Figure 7:
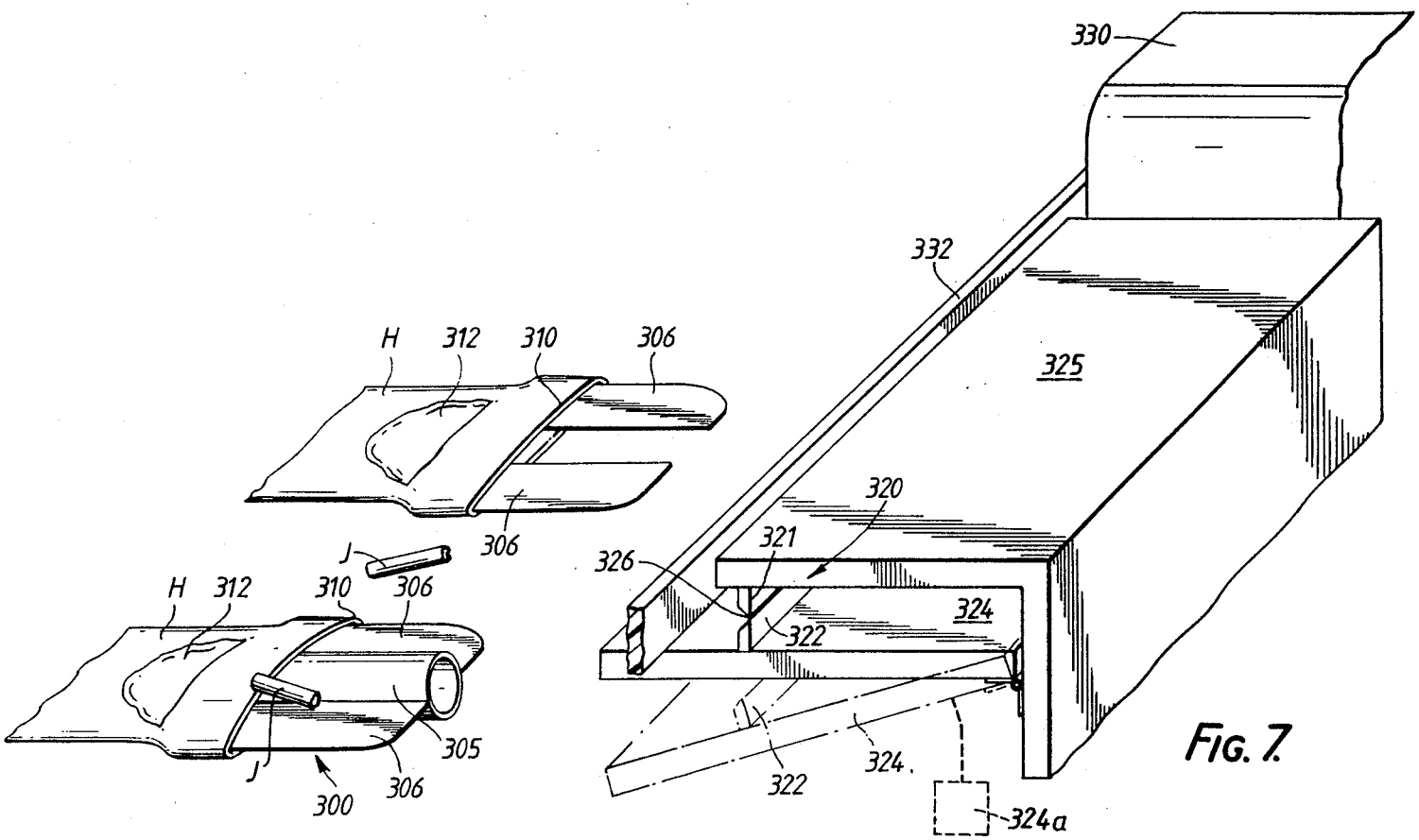
FIG. 7 is a schematic perspective view of a toe closer device enabling the toe closing of a looper line hose blank.
Figure 9A:
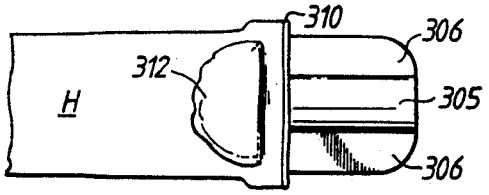
Figure 9B:
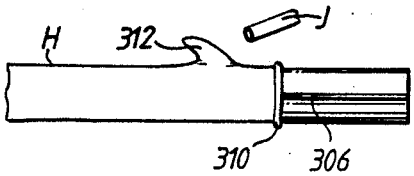

FIGS. 9A and 9B are plan and side views of a carrier and a hose blank mounted thereon; and FIGS. 10A to 10D show, in sequence, the presentation of a carrier-mounted hose blank to the device of FIG. 7 preparatory to the transport of its toe end to a seamer. As indicated hereinbefore, this invention concerns toe closers which are so constructed as to enable looper line hosiery blanks to be closed efficiently and speedily, and which place the minimum demands on operators when loading the blanks on the toe closers in their care.

A device which engages with the looper line of a blank to help position the blank and guide it in its passage toward a seamer of a toe closer will be described hereinafter. First, exemplary toe closers will be described with reference to FIGS. 1 to 6.

Figure 1:
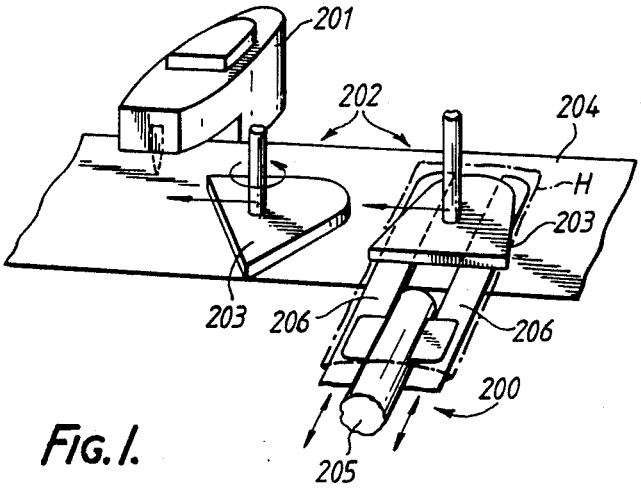
FIG. 1 is a fragmentary perspective view illustrative of apparatus for closing the toe of an item of hosiery.

In its most basic form, a common type of toe closer has a hose carrier 200, a seamer 201 and means to move the toe end of a hose to be closed automatically past the seamer 201 for a toe closing seam to be generated thereby. The toe end is in a stretched flat condition as the seam is made. The seamer 201 is usually a cutting and sewing machine such as a Union Special 39500. The means which moves the toe end past the seamer 201 can take several forms. One is shown in FIG. 1 and another in FIG. 2. In FIG. 1, the hose moving means comprises a movable clamp 202. The clamp 202 comprises a presser element 203 which coacts with a smooth worktable 204, and in use slides the toe end over the table past the seamer. The clamp presser element 203 can be raised and lowered relative to the worktable 204, respectively for admitting and clamping a hose toe end between itself and the worktable. The element 203 is movable to and fro along the worktable 204. From a hose-receiving position, the element 203 conveys the hose toe end past the seamer 201. At the seamer 201, the element 203 is moved in a predetermined manner designed to ensure a closing seam of a predetermined shape is produced. In this example, the element 203 is displaced at the seamer 201 (by means not shown) through a sequence of linear and rotary movements whereby a U-shaped, or "fish-mouth" seam is produced.

In the hose-receiving position, the presser element 203 is located opposite an end of the hose carrier 200, and is raised away from the worktable 204 ready to receive the toe end of the hose H. The toe end is presented automatically to the clamp 202, 203, 204 by the carrier 200. Carrier 200 comprises a suction tube 205 and a pair of elongated blades 206 movably mounted one to either side of the suction tube. The blades 206 are initially positioned such that free ends thereof are adjacent the free end of the suction tube 205. It is in this position the operator loads a hose H on the carrier 200. The hose H may be everted with the aid of suction in the tube 205, and then loaded by drawing it over the assembly comprising the tube and blades, such that they are located within the tubular hose. Thereafter, the blades 206 are advanced (by means not shown) forwardly away from the free end of the tube 205 and over the worktable 204 to a position beneath the raised presser element 203. The element 203 is next lowered onto the flattened hose toe end disposed upon the blades 206 which are then retracted leaving the toe end clamped between element 203 and worktable 204. The toe end can then be moved to the seamer 201 by the movable clamp 202 for the required seam to be generated.

Figure 2:
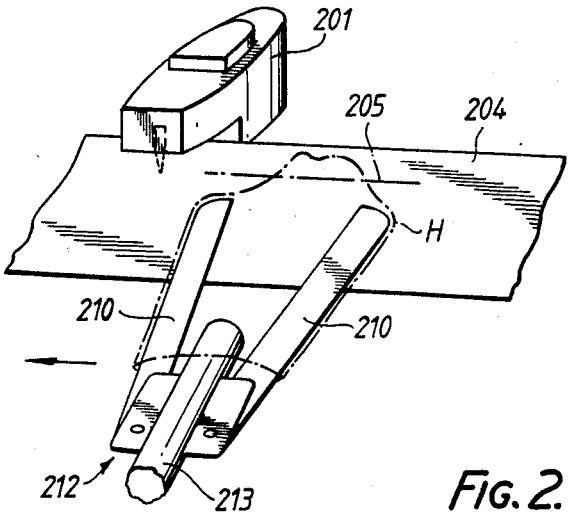
FIG. 2 is a fragmentary perspective view illustrative of modified apparatus for closing the toe of an item of hosiery.

A movable clamp is not absolutely essential, as FIG. 2 shows. Here, the blades 210 of carrier 212 are mounted on the suction tube 213 (a) to advance and place the hose toe end on worktable 204 and (b) to stretch the toe end laterally to a significant extent. This lateral stretching is accomplished by having the blades 210 affixed to pivot mountings on the suction tube 213 and by causing their free ends to move apart to the position illustrated in FIG. 2. While the blades 210 are kept in this attitude, the carrier 212 is displaced sideways conveying the hose H towards and past the seamer by a suitable drive means. As the hose toe end passes the seamer 201, e.g. moving in a straight path, a seam is formed along seam line 215. The actual seam will have a curved outline when the hose relaxes from its stretched state upon removal from the carrier 212.

Figure 3:
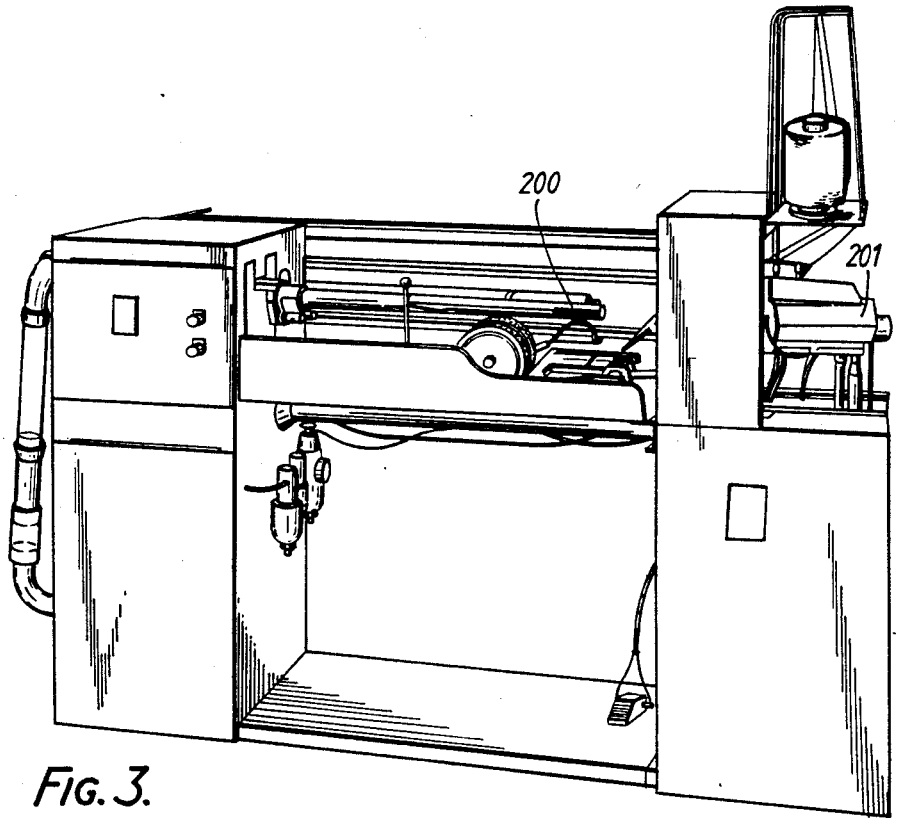
FIG. 3 is a perspective view of a complete toe closer.
Figure 4:
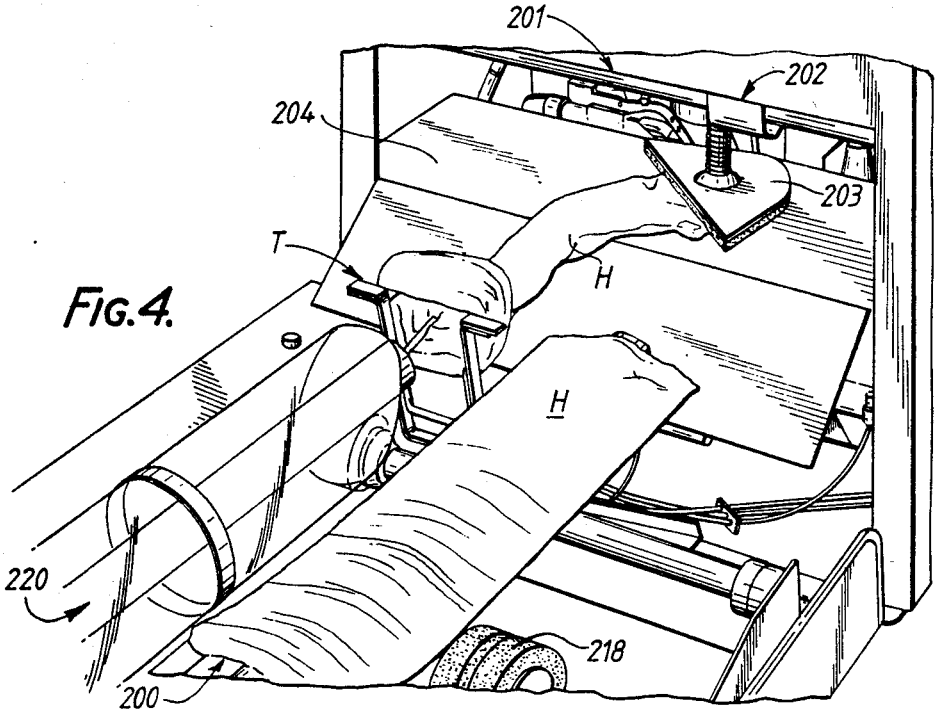
FIG. 4 is an enlarged perspective view of parts of the apparatus shown in FIG. 3.

An actual toe closer built around the concept described above in connection with FIG. 1 is shown in FIGS. 3 and 4. In addition to the parts illustrated in FIG. 1, this toe closer has a wind-on means 218 to assist loading the hose H on carrier 200, a suction everter/-pneumatic discharge means 220 and a hose-transporting means T. The latter removes the hose H from carrier 200, conveys it to the everter/discharge means 220 and presents the welt end of hose H to the latter while the toe end of the hose is under the control of the clamp 202 and is being toe closed by seamer 201. The illustrated toe closer is a SPEEDOMATIC H manufactured by Detexomat Machinery Limited. Further details are given in BP-1,408,912 and U.S. Pat. No. 3,875,880, to which reference is hereby directed.

Figure 5:
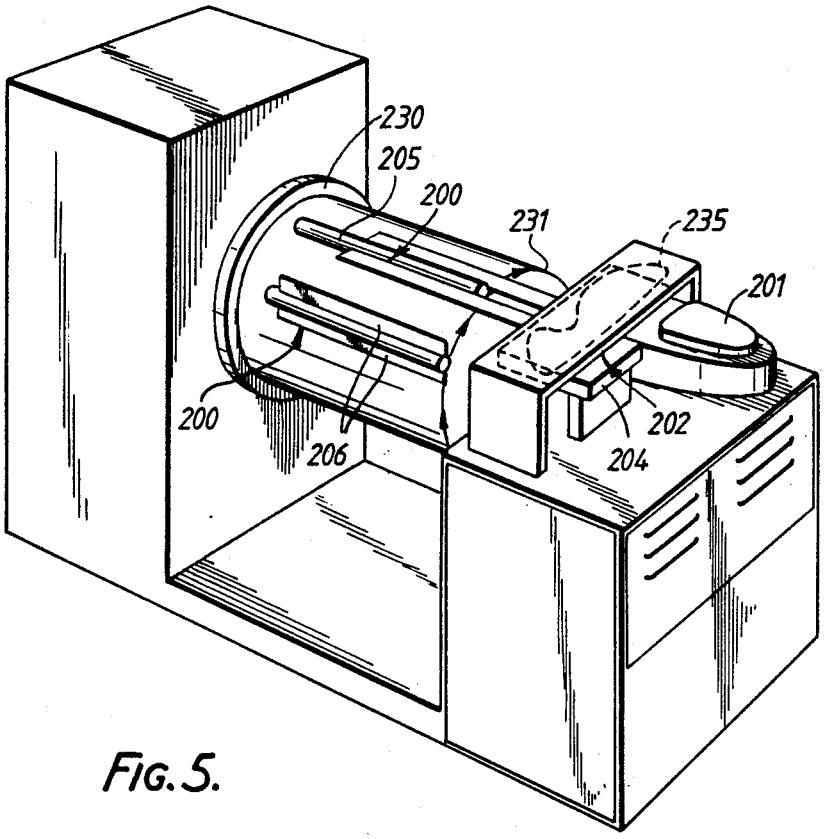
FIG. 5 is a simplified perspective of another toe closer which has a rotary turret fitted with a plurality of hose carriers.
Figure 6:
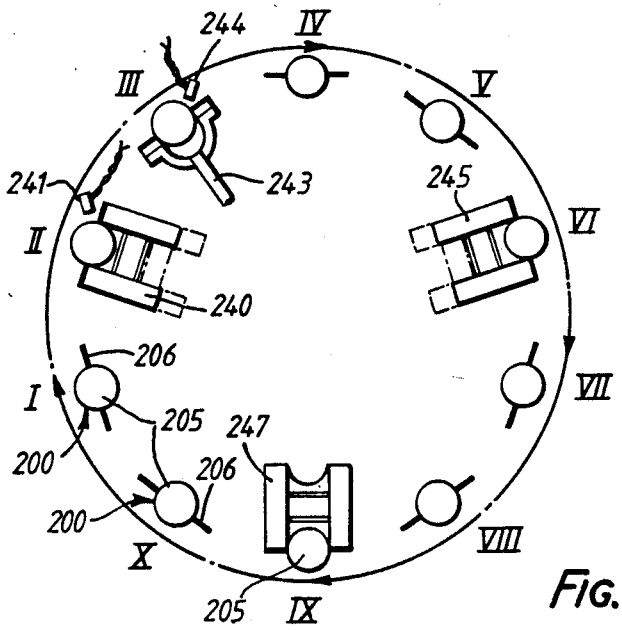
FIG. 6 is a schematic end elevation of the apparatus shown in FIG. 5 and illustrates several work stations through which hose for toe closing are conveyed in turn.

Another type of toe closer has a plurality of carriers 200 mounted on a rotary turret 230, see FIGS. 5 and 6. In this toe closer, a cycle of operations is repetitively performed on a plurality of hose in the course of rotation of the turret 230 and the productivity of the toe closer is significantly greater than the toe closer shown in FIGS. 3 and 4.

In the toe closer shown in FIG. 5, the turret-mounted carriers 200 again comprise suction tubes 205 and elongated, movable blades 206 mounted thereon. There are e.g. 6, 8 or 10 carriers 200 borne by turret 230 which is rotated (by drive means not shown) either continuously or intermittently around a closed path 231. As before, the blades 206 serve to present a hose toe end into a clamp 202. The latter is intermittently-operable and again serves to grip the toe end to be seamed and then to move it past the seamer 201. Clamp means 202 comprises an endless, intermittently-driven belt 235 and worktable 204 which extends to the seamer 201. The belt 235 is trained around pulley wheels, not shown, some of which may be adjustable to determine the shape of the seam generated. The clamp means 202 opens (to admit hose blanks for seaming and subsequently for releasing the seamed hose) and closes (to clamp toe ends and then move them past the sewing machine) respectively by lowering and raising a portion of the worktable 204.

A cycle of operations of the toe closer of FIG. 5 is now described with reference to FIG. 6. During one full cycle each tubular carrier 200 for example moves intermittently, pausing at each of ten stations I–X.

When a carrier 200 arrives at Station I, the operator loads a hose blank thereon. Carrier 200 is in communication with a source of suction to assist eversion of the blank in known manner. The welt end of the blank is turned back over the carrier 200 and manually drawn along the carrier, this and blades 206 being disposed inside the blank. The turret is then indexed to cause each carrier to rotate to the next station.

Upon arrival at station II a wind-on mechanism including a rotationally driven roller 240 is actuated to engage the hose blank and draw it fully onto the carrier 200. When the toe end of the blank passes a photo-sensor 241, roller 240 is moved out of contact with the blank.

Having indexed to station III, the hose blank toe end portion may be positioned longitudinally. This is to adjust the actual toe end accurately upon the blades 206 such that upon transfer to the clamp means 202, it will be fed thereby past the seamer to generate a seam in the requisite location. The positioner 243 is moved into engagement with the hose blank while at station III, and then shifts its toe end portion until some discernable feature on the toe end portion reaches a photo-sensor 244, whereupon a signal is generated terminating the positioning operation.

When the correctly-positioned hose blank arrives at station IV, its toe end portion is transferred to the clamp means 202 by the pair of blades 206 moving in unison away from the turret 230 and into the open clamp means 202. The free ends of blades 206 can optionally spread apart, stretching the toe end laterally. Clamp means 202 then closes nipping both toe end and blades 206. The latter then withdraw towards the turret, leaving the toe end in the clamp means. After clamp means 202 has grasped the toe end, the belt 235 is set in motion to slide the toe end across worktable 204 to a position adjacent the seamer 201.

After arrival at station V a toe closing seam is generated by the seamer 201 as the toe end is moved in unison with belt 235.

Thereafter the seamed hose still on carrier 200 is conveyed to station VI, where driven wind-on roller 245 engages the hose on the carrier 200 and draws the hose fully onto the carrier 200. This action tends to flatten the toe seam.

Subsequently, the hose passes through "spare" stations VII and VIII to station IX. At the latter station a reverse-driven wind-off roller 247 is engaged with the hose on carrier 200 and suction is applied through the tube 205. The hose is drawn toe end first into the tube by the suction, assisted by roller 247 and is then discharged from the machine. During this sucking-in action, the hose is automatically everted. After passing through "spare" station X, the unloaded carrier 200 returns to station I to be loaded with a fresh hose blank by the operator once again.

Toe closers constructed along the lines of the closer illustrated in FIGS. 5 and 6 include the SPEEDOMATIC HS machine manufactured by Detexomat Machinery Limited. Detailed descriptions of such toe closers are given in the following patents to which attention is hereby directed: GB-A-1,501,869; GB-A-1,577,758; GB-A-2,066,862 and GB-A-2,074,203; and also US-A-4,192,242; US-A-4,383,491 and 4,383,490.

In the toe closers illustrated in FIGS. 3, 4 and 5 the carriers 200 are adapted to present hose toe ends into clamp means 202. Delivery of the toe ends into a clamp means can be achieved otherwise, however. It is known, for example, to use instead movable grippers which take hold of the toe end of a hose on a carrier and draw it into the clamp means.

The clamp means shown in FIG. 5, comprising an endless movable belt 235 and a worktable 204 could be substituted for the clamp means shown in FIGS. 3 and 4, if desired.

A toe closer embodying the invention is now described with reference to FIGS. 7 to 10. This toe closer is intended to be used for toe closing tubular hose blanks which are knitted with a "barrier" or "bead" at the end of the toe run-off. Such a barrier is provided, usually, by knitting in a heavier denier yarn, which may be a covered elastomeric yarn or a cotton yarn. The barrier is located at a pre-designed position on the blank, relative e.g. to a heel or toe formation or to a reinforcement area thereof. The barrier is part of the waste discarded as the blank is seamed.

Such barriers are knitted into hose blanks for making socks.

The toe closer of this invention is adapted to utilize the barrier for the purpose of positioning the hose toe end at or just before the time of engaging the clamp means therewith. By so using the barrier, it is possible to ensure that the toe closing seam is accurately located in the finished hose or sock. Thus, the risk of producing finished hose with feet of varying length is minimized and the task of pairing hose with feet of equal length is significantly eased.

Figure 8:
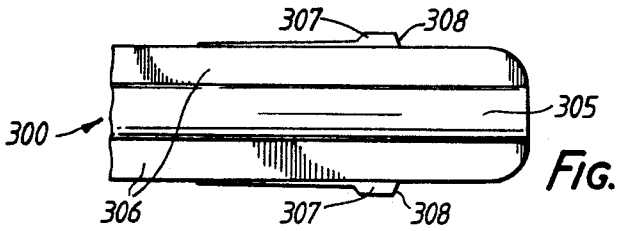
FIG. 8 is a plan view of a toe closer carrier suitable for looper line hose blanks.

Hose blanks H are mounted in the usual way on a carrier 300 of the toe closer. The carrier has a suction tube 305 and two diametrically opposed blades 306. The blades 306 have aligned ears 307 as shown in FIG. 8 on their outer edges. These ears are used by the operator to set the ends of all the blanks to a common position considered lengthwise of the carrier 300. Shoulders 308 formed by the ears provide stops against which the hose barrier 310 is pulled by the operator. The operator also adjusts the hose to place the toe pocket area 312 centrally atop the carrier 300 and tucks in the toe pocket, as indicated in FIG. 9B. This completes the operator's loading task. Suitably-positioned air-jet means J can be provided, if desired, for blowing the toe pocket rearwardly, thereby relieving the operator from having to tuck in the toe pocket. The toe pocket is so disposed — manually or by the air-jet means J — that it will be clear of the clamping belt when the belt is subsequently engaged with the blank.

After the hose blank H has been properly loaded on the carrier, the blades 306 advance forwardly in unison, to present the end of the blank to a positioning means. See FIG. 10A. The positioning means 320 comprise straight, elongated confronting upper and lower jaws 321, 322 which initially are separated sufficiently for the blades and hose end thereon to be inserted therebetween. The lower jaw 322 is affixed to a worktable member 324, the worktable member being pivoted to a support structure 325 which carries the upper jaw 321. The jaws are initially separated thanks to a lowering of the worktable member 324 through a pivoting action. When the blades 306 have executed their advance stroke and have moved the barrier 310 beyond the jaws, the worktable member 324 is raised to the position indicated in full line in FIG. 7 and in FIG. 10B. Confronting edges of the jaws 321, 322 are then closely adjacent. The gap 326 between their said edges is large enough for the fabric of the blank H to slide therein but too small for the barrier 310 to be pulled through the gap. Raising and lowering of the worktable 324 and hence the lower jaw 322 are effected by an actuator 324a, e.g. a pneumatic ram.

When the jaws 321, 322 have closed about the hose fabric, the top and bottom layers thereof are adjusted, i.e. pulled backwards towards the jaws, for the barrier to abut them, e.g. by the operator or by mechanical means described hereafter. The hose blank with the upper and lower portions of the barrier 310 aligned is thus correctly positioned for transport to the seamer 330 for the toe closing seam to be generated thereby.

Any convenient time after the jaws 321, 322 have assumed the closed position, the blades 306 are retracted.

Transport of the hose blank to the seamer 330 is performed in this example by a movable clamping belt 332, trained around pulleys on a support, neither shown for clairity. Belt 332 is spaced upwardly from the worktable until (a) the toe end of the blank H has been introduced between the jaws and (b) the barrier has been drawn against the jaws. The belt is then engaged with the blank, to press same against the worktable. Thereafter the belt 332 is set in motion to slide the hose blank toe end across the worktable and past the seamer.

Figure 10A:
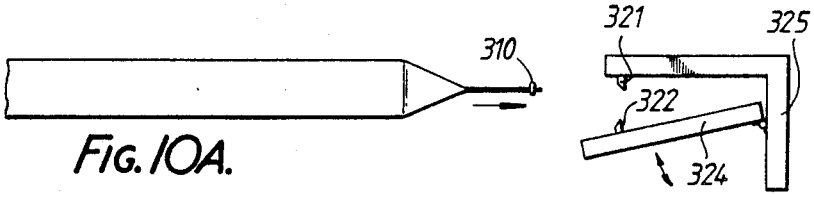
Figure 10B:
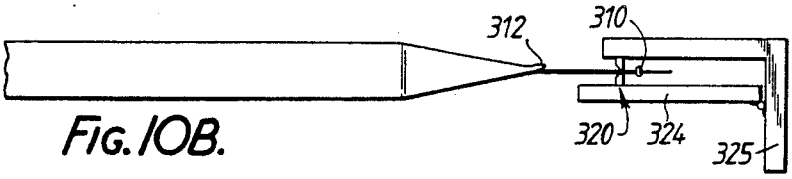
Figure 10C:
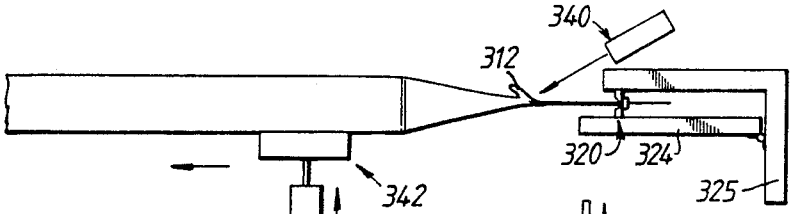
Figure 10D:
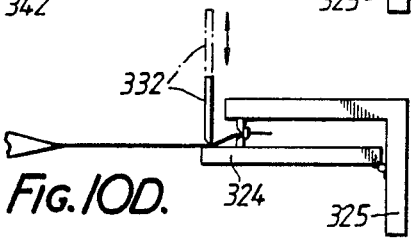

As indicated by FIG. 10D, belt 332 is lowered from a raised position to engage the hose blank. Of course, the belt could be fixed in space when the supporting structure 325 would be mounted so as to elevate to bring the hose blank into operative engagement with the belt.

The belt 332 engages the blank frictionally for sliding same across the worktable. Friction between the belt and hose is such that slippage therebetween does not occur. Accordingly, the hose positioning resulting from drawing the barrier 310 against the jaws 321, 322 of the positioning means 320 is preserved from the moment the belt engages the hose blank until it has transported the hose blank past the seamer 330. Therefore, the jaws 321, 322 need not be especially extensive. Positioned opposite the carrier 300 to admit the toe end of the blank, the jaws need not be significantly longer than the widest part of the blank as presented upon the blades 306. Nevertheless, in a preferred embodiment the jaws 321, 322 both extend from the hose-receiving position to the seamer 332 to serve as an elongated guide for the barrier 310 as the hose blank is transported to the seamer.

Although not apparent from FIG. 7, the jaws are bevelled on their faces directed to the carrier 300 to define blunt knife edges.

The belt 332 transports the hose blank along a straight line path to and past the seamer 330. A straight toe seam is thus generated across the blank. In principle, the belt could be shaped to suit a curved seam configuration — see e.g. the patents quoted above in relation to the SPEEDOMATIC HS machine — when the jaws would be similarly shaped.

The operator can pull the blank backwards to engage the barrier 310 with the jaws 321, 322, as described above. In the interests of production efficiency, essentially the same action is performed mechanically and automatically by suitable displacing means operative on the blank. The displacing means could, for instance, comprise driven rolls engageable with the blank. FIG. 10C reveals the displacing means used in the present embodiment. Here, a first displacing or pushing means 340 such as a pneumatic ram is provided for engaging the upper layer of fabric of the carrier-supported blank and for pushing this layer rearwardly to cause the upper part of the barrier 310 to abut the jaw 321. Displacing means 340 acts on the blank adjacent the toe pocket area 310. A second displacing means 342 is provided in this embodiment to displace the lower fabric layer. In principle, the displacing means 340, 342 could be of the same kind. However, in this example the second displacing means 342 comprises a pad 343 which can be elevated from beneath into contact with the carrier-supported blank and which can be shifted bodily in the rearward direction to cause the lower portion of the barrier 310 to abut the jaw 322.

In essence, the equipment shown in FIGS. 7 to 10 can be incorporated without difficulty in such toe closers as illustrated in FIGS. 1 to 6. From the point of view of productivity, it is preferred for the invention to be embodied in a plural-carrier toe closer. The type of toe closer disclosed in connection with FIGS. 5 and 6 is a particularly suitable candidate for embodying this invention.

In preferred embodiments of the invention, the toe closer has a clamping belt 332 which moves the blank along a straight path to and past the seamer 330. The jaws 321, 322 extend to the seamer as guides from the position whereat the carrier-mounted blank is presented to the jaws and the clamping means, and they extend parallel to the said path. It will be appreciated that the seam generated across the blank will be straight. Moreover, it will be understood that its actual location on the blank will depend on the relative positioning of the belt 332, the jaws 321, 322 and the seamforming means of the seamer, i.e. the needle of a sewing machine which preferably constitutes the seamer. Alteration of the relative positioning of these elements, e.g. by shifting of the seamer to and fro relative to the belt and jaws, enables the actual seam location to be adjusted.

Various modifications to the equipment disclosed herein will occur to the addressee and such can be made without departing from the spirit and scope of the invention claimed herein. There follows a non-exhaustive description of possible modifications.

As indicated above, a straight line seam is normally generated. However, despite the blank being moved past the seamer along a straight path, it is possible to derive a curved seam. This can be accomplished, when the barrier has been engaged with the jaws, by operating the first and second displacing means 340, 342 such as to produce a differential tensioning of the upper and lower layers of the fabric of the carrier-supported blank, and by retaining the differential tensioning as the blank is transported to and past the seamer. For further details, see European Pat. No. -O 177 159 and U.S. Pat. No. -A-4,609,419 the contents of which are hereby incorporated by this reference.

In preferred embodiments, a clamping means including belt 332 is used to transport the blank to the seamer 330. As indicated by FIG. 2, toe closers can solely employ a movable carrier as the means to transport the blank, movable carrier as means such as a belt being omitted. Toe closers of this kind can embody this invention. Thus, blades of the carrier of such a toe closer are first caused to present the blank between the jaws 321, 322; next, the blank is displaced rearwardly on the blades, bringing the barrier into abutment with the closed jaws, and thereafter the blades are manipulated to spread apart their free ends. By laterally spreading the blades in this way, the blank is stretched laterally and, thanks to friction between them and the blank, the latter is held immovably on the blades. The positioning established by engaging the barrier with the jaws is thus retained by friction when the carrier is moved towards and past the seamer.

In the illustrated embodiment, the positioning means 320 is opened and closed by movement of the lower jaw 322, the upper jaw 321 being fixed. By appropriate modification of the apparatus, the lower jaw could be fixed and the upper jaw 321 movably mounted for opening and closing the positioning means.

In any event, the gap 326 between the jaws 321, 322 when the positioning means is closed should be small enough that the barrier 310 cannot pull back through the gap but large enough that the clamping means can easily displace the blank laterally towards the seamer 201 or 300. Difficulties might sometimes arise in setting the gap 326 e.g. to suit hose fabrics of different thicknesses, when the gap may be too small for the blank to move easily along the jaws towards the seamer.

A modification which overcomes this problem can involve retracting the movable jaw slightly away from the companion jaw after the blank has been displaced to engage its barrier with the closed positioning means 320. Such retraction of the movable jaw enlarges the gap 326, allowing the blank to be advanced freely by the clamping means towards the seamer 201, 300.

By way of example, the lower jaw 322 is mounted for movement as described with reference to the illustrated embodiment. The upper jaw 321 is also mounted for movement. The positioning means 320 can then be opened by lowering the lower jaw, possibly also raising the upper jaw. Upon introduction of the blank between the jaws, they are closed by pneumatic means or other actuating means whereby the jaws are brought into juxtaposition for locating the barrier. When the barrier 310 has been engaged with the closed jaws 321, 322, the upper jaw 322 in this example is raised slightly by its associated pneumatic, or other, actuating means to enlarge the gap 326, freeing the hose fabric for easy movement along the jaws towards the seamer 201, 300.

We claim:

1. A toe closer for closing the toe end of a hosiery blank which terminates in a bead or barrier, a seamer and means to transport the toe end of a blank in a flattened state along a path past the seamer for the latter to generate a toe closing seam across the blank, the closer further including means to position a blank before transport to the seamer, the positioning means comprising an initially open pair of jaws located in a pre-set relation to the path of transport and the seamer, means for presenting the end of a blank through the open jaws, and means for closing the jaws about the end of a blank presented therebetween, whereby in use a blank is positioned by retraction of the blank until the terminal bead or barrier thereof abuts the closed jaws.

2. A toe closer according to claim 1, wherein the two jaws define a guide channel which extends alongside said path from the end presenting means to the seamer.

3. A toe closer according to claim 1, wherein the end presenting means comprises a hose carrier operable to effect a hose displacing movement in a longitudinal direction to present the end through the open jaws.

4. A toe closer according to claim 1, wherein the hose carrier is movable laterally, along the said path, and serves as the hose transporting means, the hose carrier being adapted to hold the blank immobile.

5. A toe closer according to claim 4, wherein the hose carrier is adapted to hold the blank immobile by friction between the blank and the carrier.

6. A toe closer according to claim 1, wherein the hose carrier is movable laterally, along the said path, and serves as the hose transporting means and is operative to maintain the bead or barrier in engagement with the positioning means during transport of the hose to the seamer.

7. A toe closer according to claim 4, wherein in use the blank is positioned by pulling at least a toe end region thereof longitudinally backwards on the carrier to abut the bead or barrier with the closed jaws, the carrier has a pair of movable blades which are displaceable apart laterally after positioning of the blank, to stretch the toe end region into a flattened state and to immobilize the said region on the blades by friction, in operation said blades being retained in the laterally displaced state while the carrier transports the blank to the seamer.

8. A toe closer according to claim 1, wherein the end presenting means comprises hose supporting means movable in a first longitudinal direction to present the end through the open jaws and in a second longitudinal direction away from the jaws after closure thereof, and the hose transporting means comprises clamping means movable adjacent said jaws in a lateral direction along the said path.

9. A toe closer according to claim 8, wherein the clamping means comprises a transport belt and an opposed stationary support surface between which the said end is nipped, and the belt of said clamp means is movable along a straight line path past the seamer.

10. A toe closer according to claim 1, further including means engageable with the blank to displace the latter longitudinally to bring the bead or barrier into abutment with the closed jaws.

11. A toe closer according to claim 10, further including a hose carrier to hold the end of said blank in a flattened state, and said displacing means comprises separate displacers each engageable with a respective one of two superposed layers of fabric of the flattened blank.

12. A toe closer according to claim 1, which has a plurality of hose carriers movable around a closed path, wherein each, in turn, visits a plurality of stations in the course of an operating cycle around the closed path, and the said positioning means is located at one of said stations.

13. A toe closer for closing the toe ends of hosiery blanks which terminate in a thickened bead, comprising:

a seamer;

hose carriers for mounting blanks for toe closing, said carriers each being movable, in turn, sequentially through a plurality of stations including a loading station, a positioning station and a seaming station;

means to transport toe ends of the blanks in turn along a transport path to said seaming station for the seamer to generate a toe closing seam across each blank; and means to position each toe end to place said bead thereof at a datum position prior to transport of the toe end to said seamer;

said positioning means comprising a pair of jaws aligned generally parallel with said transport path and located in a predetermined datum position with respect to said seamer and said transport path, said jaws being adapted to execute opening and closing movements respectively for receiving a toe end to be positioned and thereafter for positioning the toe end by engagement of the thickened bead with the closed jaws;

said positioning means being operatively associated with toe end displacing means which displacing means is operable to displace the toe end of a blank located between the closed jaws in a direction whereby said bead is abutted with the jaws, thereby to locate the bead at said datum position;

said jaws, in the closed condition, being adapted to define a gap through which the toe end can freely move but which is smaller than the bead;

each of said hose carriers being adapted to execute reciprocal movements at the positioning station for advancing the toe end of a blank carried thereby between the opened jaws of said positioning means; and said transport means being operable, after said bead of each blank has been positioned at said datum position, to displace the toe end along said gap and along said transport path to said seaming station, said transport means being operative to preserve the positioning of said bead during displacement of the toe end along said path.

* * * * *